United States Patent [19]

Sekino

[11] Patent Number: 5,052,679

[45] Date of Patent: Oct. 1, 1991

[54] SORTING APPARATUS

[75] Inventor: Shizuo Sekino, Saitama, Japan

[73] Assignee: Fuji Photo Film, Co., Ltd., Kanagawa, Japan

[21] Appl. No.: 451,707

[22] Filed: Dec. 18, 1989

[30] Foreign Application Priority Data

Dec. 19, 1988 [JP] Japan ..... 63-319748

[51] Int. Cl.[5] ..... B65H 5/04

[52] U.S. Cl. ..... 271/293; 271/294; 271/306; 414/790.4; 414/790.3

[58] Field of Search ..... 271/279, 287, 292, 293, 271/294, 295, 306, 198, 213, 220, 903; 221/76, 119; 354/319; 414/790.4, 790.3, 789.9, 790.7; 198/484.1, 803.13

[56] References Cited

U.S. PATENT DOCUMENTS 2,561,070 7/1951 Phythian ..... 271/294 X 4,824,307 4/1989 Johnson et al. ..... 414/790.4 X

FOREIGN PATENT DOCUMENTS 6326662 2/1988 Japan .

*Primary Examiner*—David H. Bollinger

*Attorney, Agent, or Firm*—Sughrue, Mion, Zinn, Macpeak & Seas

[57] ABSTRACT

An apparatus for sorting photographs has an endless track, driven in upper and lower paths, which bears a plurality of racks, at regular spacings, which are placed in a loading position to receive sheets by groups. A plurality of tray boards form a rack between each two adjacent tray boards for receiving a group of the sheets. The tray board includes a bottom plate attached to the endless track and formed with two slots, a partition plate extending upwardly from the bottom plate to make the rack stand vertically when the rack is on the upper path. Two supporting brackets are secured to the partition plate and extend rearwardly from the partition plate for supporting thereon the group of sheets received in the rack, each supporting bracket being received in the slots of the bottom plate of another of the adjacent tray boards.

6 Claims, 5 Drawing Sheets

SORTING APPARATUS

BACKGROUND OF THE INVENTION

The present invention relates to a sorting apparatus for sorting sheet materials, such as photographic prints or copies, by specified group.

Various kinds of sorting apparatus are used to sort photographic prints by specific group, such as order number. Such a sorting apparatus includes a chute, disposed below a photographic printer outlet, for receiving a set of prints having the same order number. The chute feeds prints, set by set, into box-shaped racks arranged on an endless belt at regular spacings, to sort a large number of prints by order number. Such a sorting apparatus is known from Japanese Unexamined Utility Model Publication No. 63(1988)-26,662, for example.

To feed an entire set of prints received in the chute into the box-shaped rack at once, the set of prints should be thinner than the depth of the box-shaped rack. For this reason, it is necessary to provide a guide for depressing the set of prints as much as possible upon feeding them into the box-shaped rack. Such structure makes the sorting apparatus quite complex.

SUMMARY OF THE INVENTION

In view of the foregoing, it is an object of the present invention to provide a sorting apparatus which can load prints or printed sheets into racks by group and support a group of prints with their edges made even in the rack.

The above and other objects of the present invention are achieved by providing a sorting apparatus having an endless track, which bears a plurality of racks arranged at regular spacings, for placing the racks in a predetermined loading position where a group of prints or printed sheets delivered from an outlet of a printing apparatus, such as a photographic printer or a copying machine, are loaded in the rack one after another, thereby sorting the prints or printed sheets by group. The endless track is moved by a motor so that the racks circulate along upper and lower paths which are on an incline. A plurality of tray boards form the racks, one rack being between each pair of adjacent tray boards.

Each tray board includes: a bottom wall plate which is attached to the endless track and which is formed with at least two slots extending along a direction in which the endless track moves; a partition wall plate, extending upwardly from one end of the bottom wall plate so as to make the rack stand vertically when the rack goes from the lower path to the upper path, and at least two supporting brackets, secured to a bottom portion of the partition wall plate and extending rearwardly from the partition wall board, for supporting thereon the group of sheets received in the rack. The supporting bracket is received in the slots formed in the bottom wall plate of another of the adjacent tray boards. The group of sheets are received by the rack when the partition wall plate is inclined during a transition of the rack from the lower path to the upper path.

BRIEF DESCRIPTION OF THE DRAWINGS

The above and other objects and features of the present invention will be understood from the following detailed description directed to a preferred embodiment of the present invention, taken along with the accompanying drawings, in which the same parts are designated by the same reference characters throughout the several drawings, and wherein.

DETAILED DESCRIPTION OF THE PREFERRED EMBODIMENTS

Figure 1:
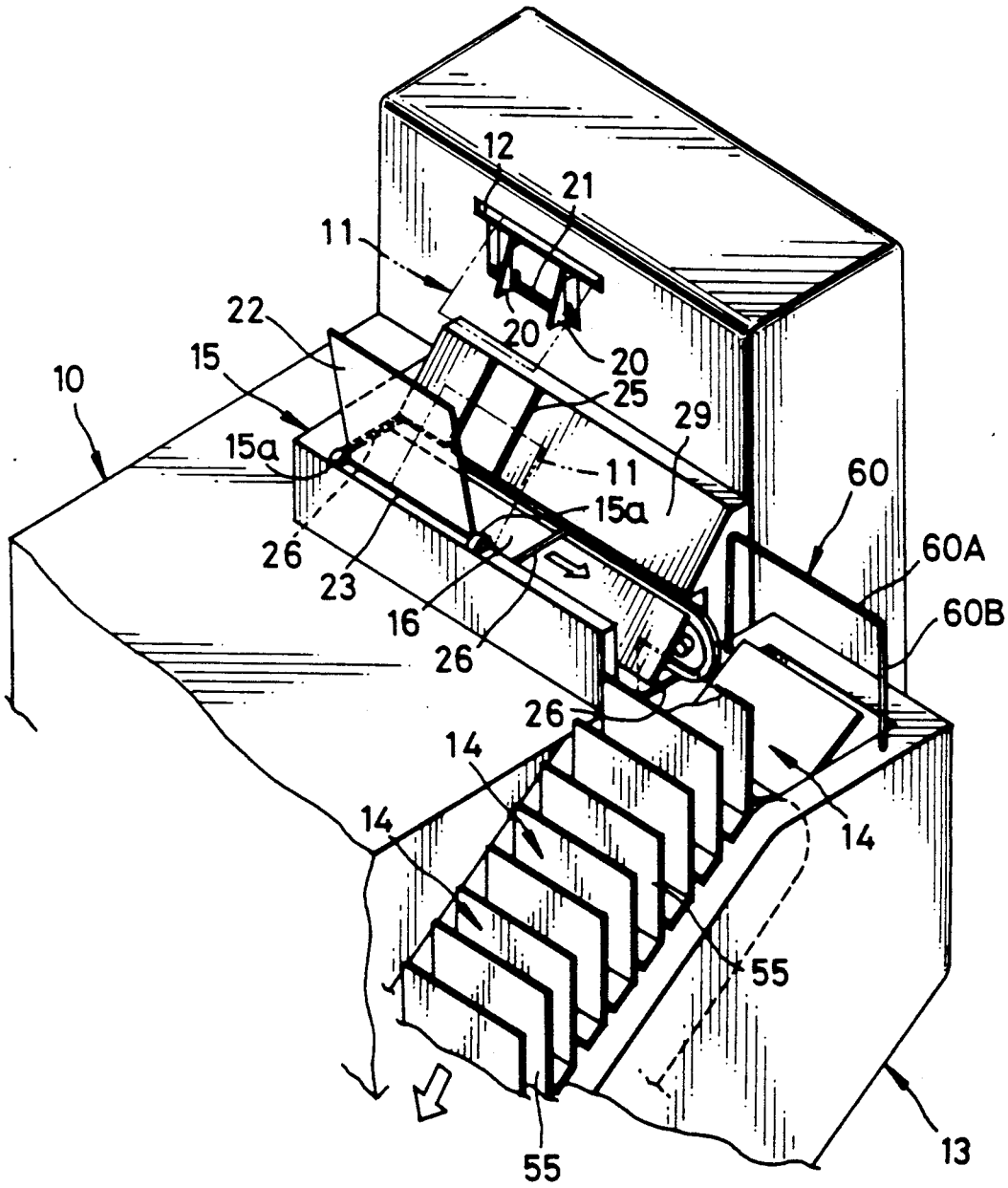
FIG. 1 is a schematic perspective illustration of a sorting apparatus in accordance with a preferred embodiment of the present invention.

Referring to the drawings, in particular to FIG. 1, a sorting apparatus 13 in accordance with a preferred embodiment of the invention is attached to and cooperates with a printer-processor 10 in which a color paper is exposed to a negative, is developed, and then is cut into individual prints 11 in a well known manner. The prints 11 are delivered to the sorting apparatus 13 through an outlet 12. A feeder 15, for feeding the prints 11 into one of a row of racks 14 of the sorting apparatus 13 by ordering number, is arranged below the outlet 12 of the printer-processor 10. The racks 14 are arranged on an endless chain conveyor 53 (see FIG. 6) with their bottoms in step.

The outlet 12 of the printer-processor 10 is provided with a pair of guide plates 20 which direct the print 11 toward a chute 16 of the feeder 15 located below the outlet 12. The guide plates 20 are mounted slidably on a guide rod 21 for adjusting the distance therebetween according to various sizes of prints. Between the outlet 12 and the chute 16, there is a guide plate 22 having a mounting rod 23 supported by brackets **15*a* of the feeder 15 for guiding the leading end of the print 11 coming out through the outlet 12 toward the chute 16. The guide plate 22 is disposed at an angle which is adjusted with respect to directions in which prints are ejected from the printer-processor 10 through the outlet 12**.

The feeder 15 is provided with the chute 16 disposed below the outlet 12 and laid transversely with respect to the printer-processor 10, and a sweeping bar 26 for sweeping prints 11, accumulated in the chute 16 by order number, into one of the racks 14. The chute 16, as shown in FIG. 2, includes a tray 27 having a V-shaped cross section, and an upper guide plate 29 facing the outlet 12 in a plane extending generally in the same direction as one wall 27A of the V-shaped tray 27, a spacing or clearance 28 being provided between the upper flange of the one wall 27A and the lower edge of the upper guide plate 29.

Figure 3:
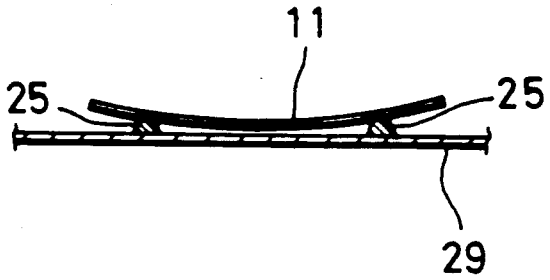
FIG. 3 is an enlarged cross-sectional view of FIG. 2 taken along line III—III.

Referring to FIG. 3, because one photosensitive surface (image forming surface) of the print 11 has an emulsion layer applied thereto, the print 11 tends to curl on one surface after developing. To prevent curling of the print 11, the upper guide plate 29 is provided with a pair of guide rails 25 disposed parallel to each other and facing the adjustable guide plate 22 to prevent the print 11 from lateral displacement after falling down from the outlet 12. As shown in FIG. 3, when the curled print 11 falls down on the guide plate 29, it is supported on and restricted by the guide rails 25, so that there is no lateral displacement of the print on the guide plate 29. Thus the print 11 is put in a fixed location on the V-shaped tray 27.

Figure 2:
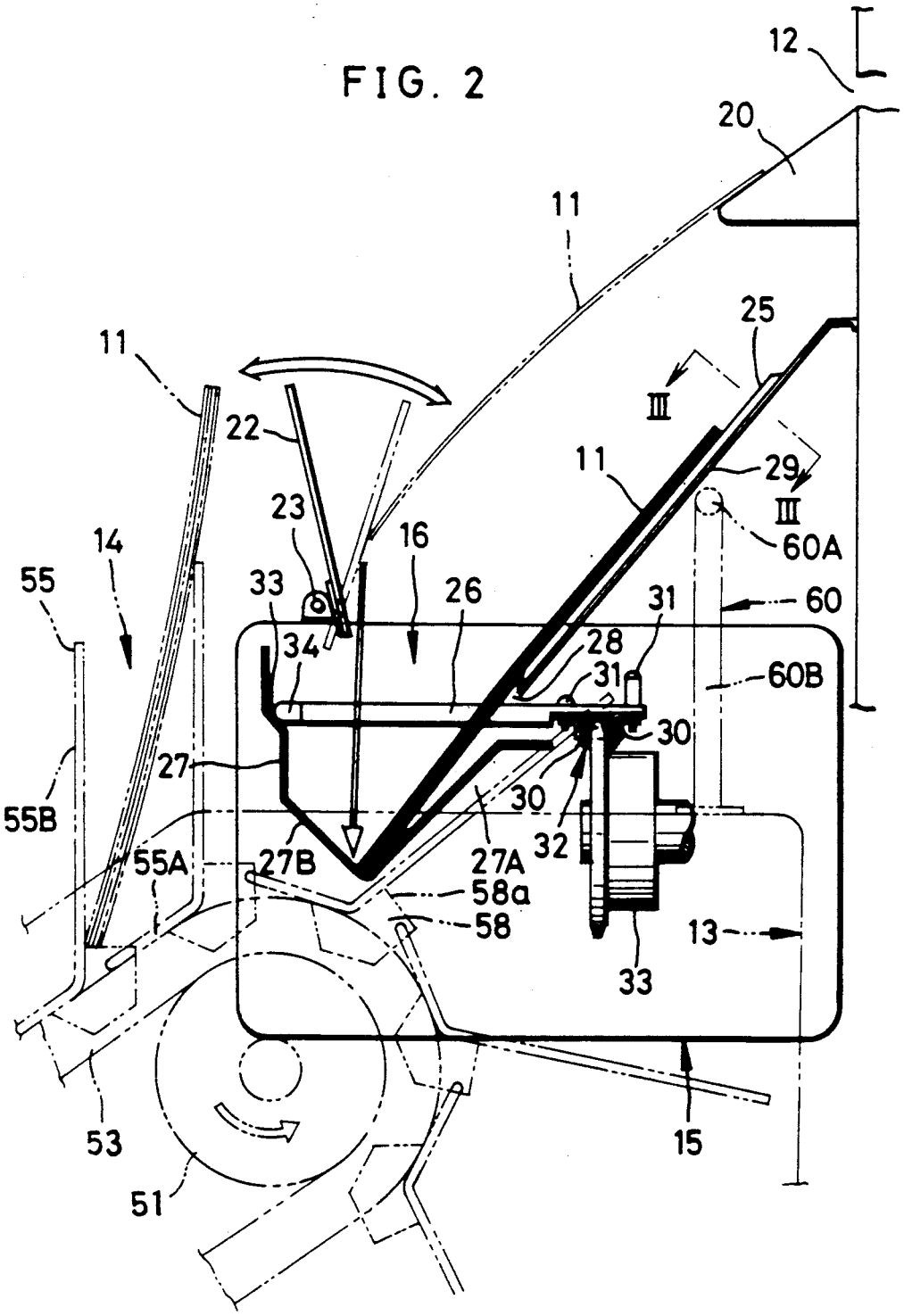
FIG. 2 is a side view showing a feeder included in the sorting apparatus shown in FIG. 1.

As shown in FIG. 2, the sweeping bar 26 is provided with a bracket 30, secured to one end thereof with a set screw 31, and coupled to an endless chain 32. Although only one sweeping bar 26 is illustrated in FIG. 1 or 2, as a practical matter four sweeping bars 26 are provided at regular spacings in a transverse direction in which the endless chain 32 moves. The other end of the sweeping bar 26 is guided slidably by a shoulder or step 33 formed in the other wall 27B of the V-shaped tray 27 so as to keep the sweeping bar 26 horizontal during movement in the transverse direction. To reduce drag between the step 33 of the other wall 27B of the V-shaped tray 27 and the sweeping bar 26, the other end of the sweeping bar 26 is covered with a plastic cap 34.

Figure 4:
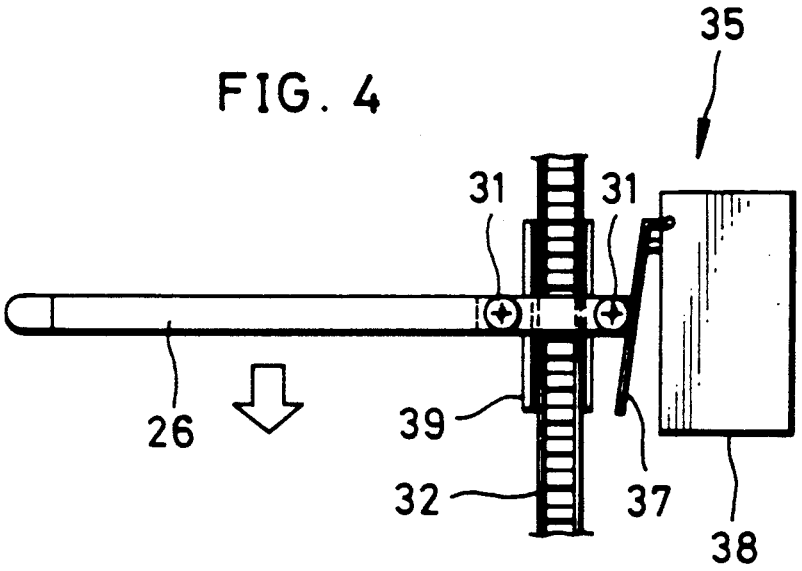
FIG. 4 is a plan view showing a sweeping bar sensor.
Figure 5:
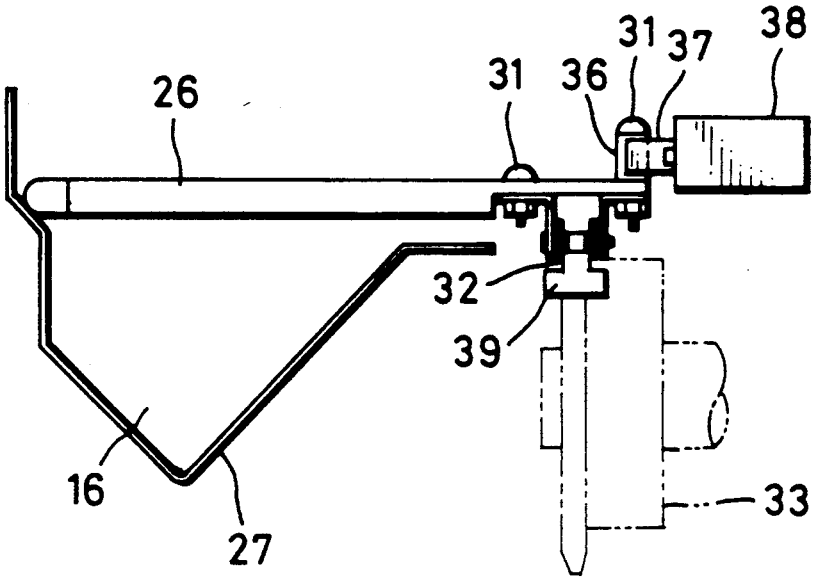
FIG. 5 is a side view of FIG. 4.

The endless chain 32 is stretched between two sprocket wheels 33 with a proper tension so as to be kept horizontal. As shown in FIGS. 4 and 5, a sensor 35 is provided at a specific location in the transverse direction for stopping the sweeping bar 26 at a specific position upon detecting the print 11 coming off the chute 16. The sensor 36 includes a limit switch 38 consisting of a striker 36 secured to the end of the sweeping bar with one of the set screws 31, and an actuator 37 actuated by the striker 36. When the striker 36 strikes the actuator 37, the limit switch 38 is turned on.

To prevent the endless chain 32 from deflecting with the reaction of the striker 36 caused by the striker 36 striking the actuator 37, thereby disabling the sensor 35 to detect the print coming from the chute 16, a guide member 39 is provided to prevent deflection of the endless chain 32. The guide member 39 is received in holes of the endless chain 32 to prevent the endless chain 32 from deflecting. The actuator 37 may be struck by the one end of the sweeping bar 26 in place of the striker 36. The mechanical limit switch 38 for the sensor 35 may be replaced with an optical sensor well known in the art.

Figure 6:
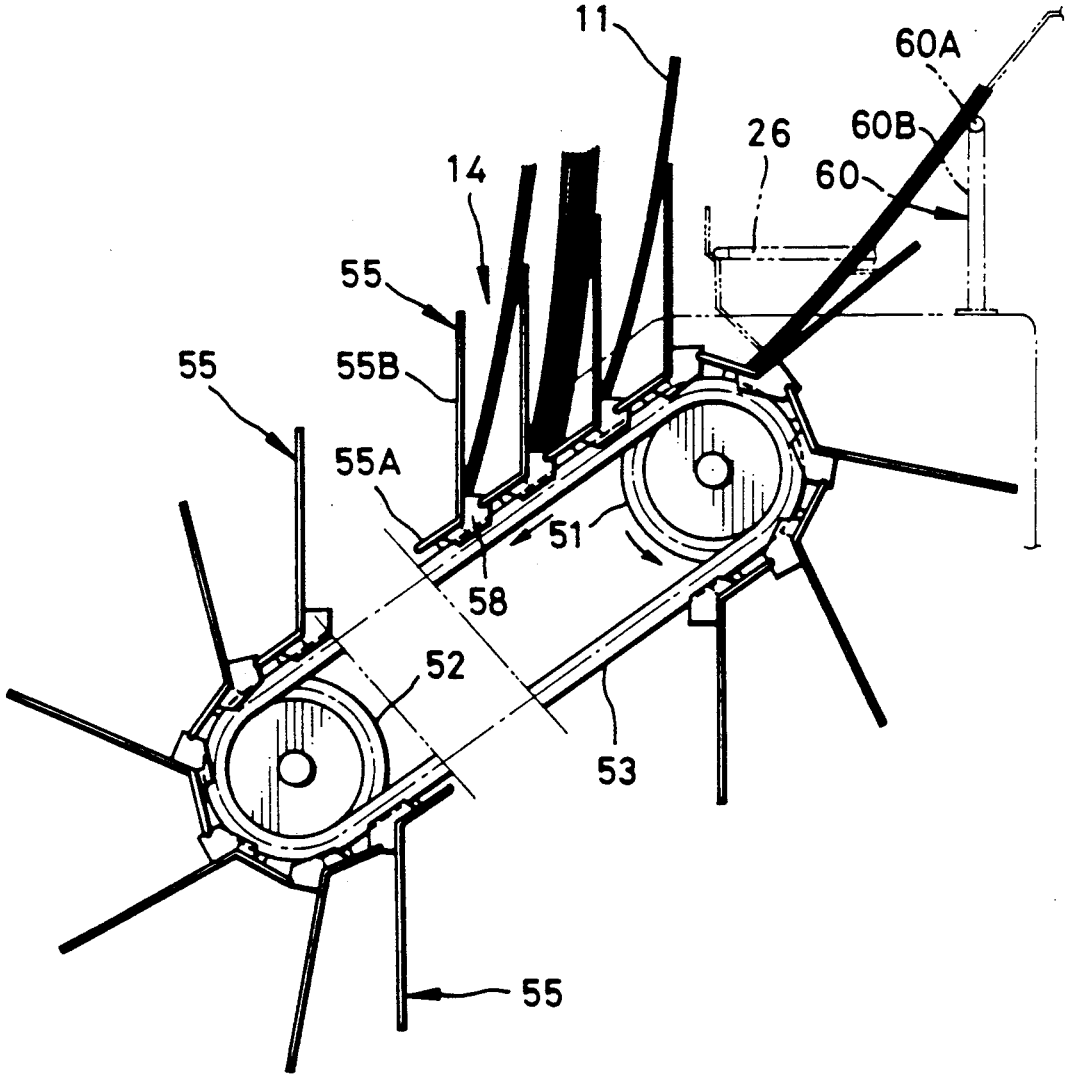
FIG. 6 is a side view showing a rack arrangement for receiving sorted groups of prints.
Figure 7:
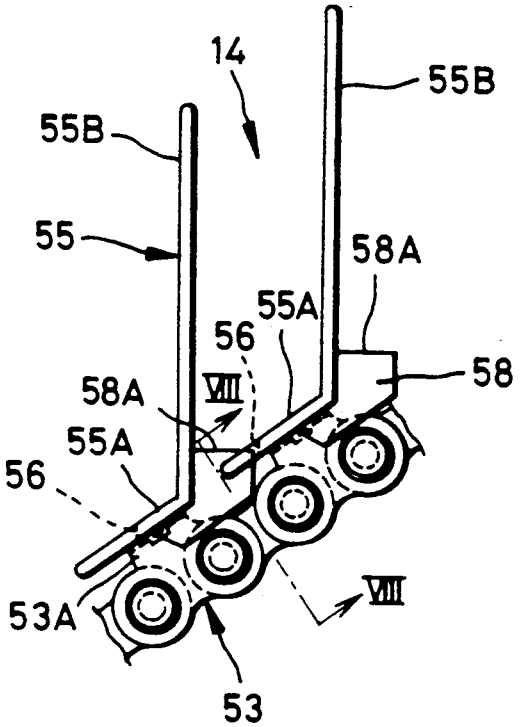
FIG. 7 is an enlarged side view showing a rack.
Figure 8:
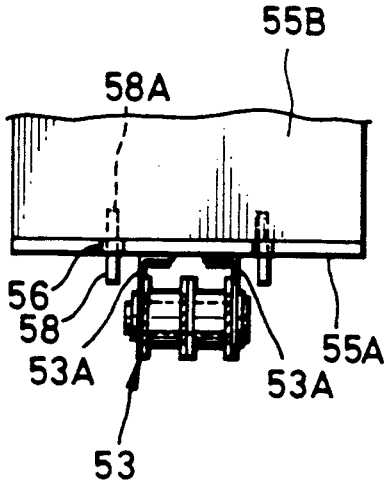
FIG. 8 is cross-sectional view of FIG. 7 taken along line VIII—VIII.

Referring to FIG. 6, the sorting apparatus 13 includes a pair of sprocket wheels 51 and 52 arranged vertically and horizontally apart from each other. An endless chain 53 is stretched between the sprocket wheels 51 and 52. A plurality of tray boards 55 are arranged side by side at regular spacings on the endless chain 53 to form the racks 14. As shown in FIG. 7, each tray board 55 includes a bottom wall 55A secured to the endless chain 53 and a partition wall 55B formed integrally with the bottom wall 55A. The partition wall 55B of the tray board 55 is bent at an angle with respect to the bottom wall 55A so as to be substantially parallel to the upper guide plate 29 when it is brought beside the chute 16 to receive a group of prints 11, and so as to be vertical when it is brought after the chute 16. The endless chain 53 has double chains in order to prevent the tray board 55 from oscillating sideways on the endless chain 53. As shown in FIG. 8, the tray board 55 is secured by fastening the bottom wall 55A to brackets 53A attached to both sides of the endless chain 53 with set screws.

Figure 9:
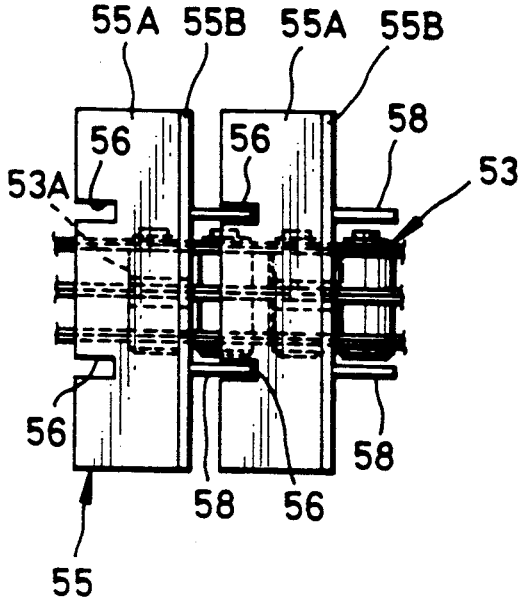
FIG. 9 is a plan view of FIG. 7.

As shown in FIG. 9, each tray board 55 is provided with a pair of slots 56 formed in a front portion of the bottom wall 55A opposite to the portion from which the partition wall 55B is bent upwardly, each slot 56 extending in a direction in which the endless chain extends. Each slot 56 receives therein a supporting bracket 58 integrally formed with the partition wall 55B of the tray board 55 located in front of the tray board 55 in which the slot 56 is formed. The supporting brackets 58, which are shaped to have an upper edge 58A at a right angle with respect to the partition wall 55B, prevent the prints 11 in the rack 14, defined by adjacent partition walls 55B and the bottom wall 55A, from slipping out through a space formed between the front edge of the bottom wall 55A and the partition wall 55B of the tray board 55 in front of the tray board 55.

When the sprockets 51 and 52 rotate, the tray boards 55 are brought aside the feeder 15 to form the racks 14 standing up vertically. Lower edges of the prints 11 received in each rack 14 are not only prevented from slipping out the rack 14 but also certainly supported on the upper edges 58A of the supporting brackets 58 received in the slots 56 formed in the bottom wall 55A of the tray board 55. The supporting bracket 58, with its horizontal upper edge 58A. supports the prints 11 to be of equal height in the rack 14, thereby making it easy to take them from the rack 14.

Figure 10:
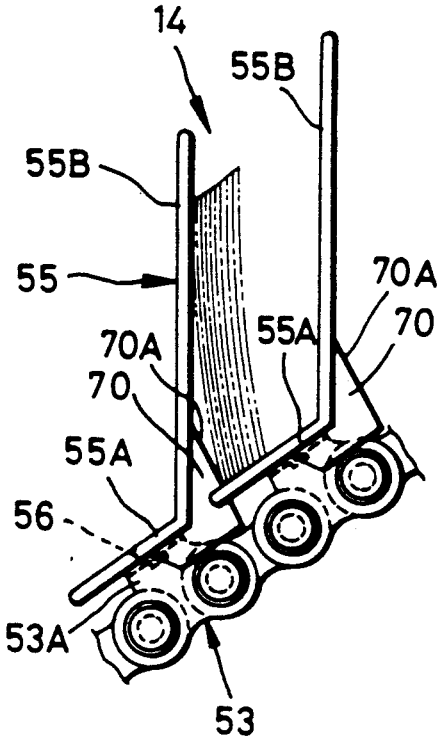
FIG. 10 is an enlarged side view, similar to FIG. 7, showing a rack in accordance with another preferred embodiment of the invention.

Although in the above illustrated embodiment the upper edge 58A of the supporting bracket 58 is horizontal when the tray board 55 is brought aside the feeder 15 and is ready to receive prints 11, it may be replaced with a supporting bracket 70 whose upper edge 70A is at an angle greater than 90° with respect to the vertically standing partition wall 55B of the tray board 55, as shown in FIG. 10. In this case, the lower edge of the prints 11 slips backward in the direction in which the tray board 55 moves. Accordingly, the prints 11 at their upper portions lean against, and are supported by, the partition wall 55B of the rack 14 which is frontally adjacent to the rack 14 wherein the prints 11 are received.

As seen clearly in FIG. 6, because the tray boards 55 around the sprocket wheel 51 are distributed radially relative to the center of rotation of the sprocket wheel 51, the closer the tray boards 55 approach the feeder 15, the narrower each space defined between each two adjacent tray boards 55 becomes. Accordingly, the prints 11 are pushed easily into the rack 14 as a unit even without being pressed thinly.

If prints longer than the height of the partition wall 55B of the tray board 55 are received in the rack 14, upper portions of the prints extend beyond the upper edge of the partition wall 55B of the tray board 55 beside the chute 16 as shown in FIG. 2, and accordingly hang down with their own weight, or the group of prints 11 slip out from the rack 14. In order to prevent a group of prints 11 from hanging down, a girder 60, which consists of a transverse arm 60A and side posts 60B, is provided on the sorting apparatus 13 and is shaped in a flat arch so as not to obstruct the tray board 55, thereby supporting the upper portion of the group of prints 11 when it is pushed laterally by the feeder 15. The transverse arm 60A of the girder 60 is located under a plane extending the upper guide plate 29 of the chute 16 so that the side post 60B does not obstruct the group of prints 11.

In the operation of the sorting apparatus illustrated above by way of an preferred example, the printer-processor 10 prints cut marks and order identification marks or order numbers on the printed color paper for respective frames and respective order groups of frames, respectively. The printed color paper is cut into individual prints at the cut marks. A sort mark sensor (not shown), which is incorporated in the printer-processor 10 at least before the outlet 12, detects the order identification mark of each print 11 to provide both the sorting apparatus 13 and the feeder 15 with an actuating signal. In such a manner, the color paper with a series of a great number of printed frames is cut into individual prints 11 and is delivered to the chute 16 of the sorting apparatus 13 through the outlet 12 of the printer-processor 10. When the sort mark sensor detects a sort mark printed on prints different from the sort marks printed on prints that have passed through the outlet 12, the sensor provides both the sorting apparatus 13 and the feeder 15 with an actuation signal.

As was previously described, the print 11 delivered into the chute 16 curling with its printed surface up is guided by the slides down along the guide rails 25 of the upper guide plate 29 of the chute 16. The guide rails 25 prevent the print 11 from moving laterally, thereby contributing to accurate piling of prints on top of one another in the chute 16.

When the sort mark sensor 35 detects a different sort mark, it provides both the sorting apparatus 13 and the feeder 15 with an actuation signal. As a result, either or both of the sprocket wheels 51 and 52 are turned so as to move the endless chain 53. At the same time, the sweeping bar 26 of the feeder 15 is moved to push out a group of prints in the chute 16 onto the tray board 55B of the rack 14 which is inclined aside the chute 16.

After pushing out the group of prints 11, the striker 36 mounted on the sweeping bar 36 strikes the actuator 37 of the sensor 35. Then, the sensor 35 provides a stop signal to stop the sprocket wheels 51 and/or 52 after a predetermined time sufficient to displace the rack 14 from the side of the chute 14 receiving the group of prints 11, raising vertically the group of prints 11 and bringing the next tray board 55 aside the chute 16 so as to open a rack 14 widely to the chute 16.

While displacing the rack 14 with the group of prints 11 received therein, the lower edge of the prints 11 slides on the bottom wall 55A of the tray board 55 and rides on the upper edge 58A of the supporting bracket 58. As a result, the prints 11 lean against the back of the partition wall 55A of the tray board 55 of the rack 14 with their upper edges put even. If a large number of prints 11 are received in the rack 14, they are supported on the supporting bracket 58 and the bottom wall 55A of the tray board 55 of the rack 14.

At the time the sprocket wheel 51 and/or 52 is advanced, prints 11 having the different sort mark for another order group are delivered into the chute 16. In the same manner as described above, a number of groups of prints 11 are delivered into the racks 14 by group. Each rack 14 is advanced by the endless chain 53 step by step to a pick-up station (not shown) where an operator picks up the group of prints and puts them into an envelope.

It is to be noted that although the endless chain 53 is shown as including two endless chains to prevent the tray boards 55 from lateral movement, of course it is permissible to use a single endless chain or another type of endless belt, such as a toothed endless chain stretched between gears.

Although the present invention has been fully described by way of the preferred embodiment thereof with reference to the accompanying drawings, various changes and modifications will be apparent to those of working skill in this technical field. Therefore, unless these changes and modifications depart from the scope of the present invention as defined in the appended claims, they should be construed as included therein.

What is claimed is:

1. A sorting apparatus having an endless track driven in revolving fashion, said endless track having upper and lower reaches, said endless track bearing bears a plurality of racks arranged at regular spacings so as to place said racks in a predetermined loading position at which a group of printed sheets are loaded in each of said racks one after another, thereby sorting said printed sheets by group, said sorting apparatus comprising:

driving means for driving said endless track and moving said racks along said upper and lower paths; and a plurality of tray boards, each two adjacent ones of said tray boards forming each of said racks for receiving said group of sheets;

said tray board comprising:

a bottom wall plate attached to said endless track, said bottom wall plate being formed with at least two slots extending along a direction of said endless track;

a partition wall plate extending upwardly from one end of said bottom wall plate, said partition wall plate being bent at an angle with respect to said bottom wall plate so as to make said rack stand vertically when said rack moves from said lower path to said upper path; and at least two supporting brackets, secured to a bottom portion of said partition wall plate and extending rearwardly from said partition wall plate, for supporting thereon said group of sheets received in said rack, each said supporting bracket being received in said slots formed in said bottom wall plate of another of said adjacent ones of said tray boards.

2. An apparatus as defined in claim 1, wherein said partition wall plate includes means for receiving said group of sheets by said rack during a transition of said rack from the lower path to the upper path and before said rack stands vertically.

3. An apparatus as defined in claim 1, wherein said supporting bracket has an upper edge extending at a right angle with respect to said partition wall plate.

4. An apparatus as defined in claim 1, wherein said supporting bracket has an upper edge extending at an angle greater than 90° with respect to said partition wall plate.

5. A sorting apparatus having an endless track driven in revolving fashion, said endless track having upper and lower reaches, said endless track bearing a plurality of racks, arranged at regular spacings, for placing said racks in a predetermined loading position where a group of printed sheets delivered from an outlet of a printing apparatus are loaded in said racks one after another, thereby sorting said printed sheets by group, said sorting apparatus comprising:

driving means for driving said endless track and moving said racks along said upper and lower reaches;

loading means, including a receiver disposed below said outlet, for receiving said group of printed sheets and loading said group of printed sheets into said racks; and a plurality of tray boards, forming said rack between each two adjacent ones of said tray boards for receiving a group of said sheets;

said tray board comprising:

a bottom wall plate attached to said endless track, said bottom wall plate being formed with at least two slots extending along a direction of said endless track;

a partition wall plate, extending upwardly from one end of said bottom wall plate, said partition wall plate being bent at an angle with respect to said bottom wall plate so as to make said rack stand vertically when said rack moves from said lower path to said upper path; and at least two supporting brackets, secured to a bottom portion of said partition wall plate and extending rearwardly from said partition wall board, for supporting thereon said group of sheets received in said rack, each said supporting bracket being received in said slots formed in said bottom wall plate of another of said adjacent ones of tray boards.

6. An apparatus as defined in claim 5, wherein said partition wall plate includes means for receiving said group of sheets by said rack during a transition of said rack from the lower path to the upper path and before said rack stands vertically.

* * * * *